US005401363A

United States Patent [19]

Begemann et al.

[11] Patent Number: 5,401,363

[45] Date of Patent: Mar. 28, 1995

[54] METHOD OF HOMOGENIZING THE CONSTITUTION OF A WEB OF PAPER

[75] Inventors: Ulrich Begemann, Leonberg; Helmut Heinzmann, Böhmenkirch; Wolfgang Ruf, Heidenheim, all of Germany

[73] Assignee: J. M. Voith GmbH, Heidenheim, Germany

[21] Appl. No.: 147,622

[22] Filed: Nov. 5, 1993

[30] Foreign Application Priority Data

Nov. 5, 1992 [DE] Germany ..... 42 37 309.3

[51] Int. Cl.[6] ..... D21H 23/06

[52] U.S. Cl. ..... 162/164.6; 162/168.2; 162/168.3; 162/183; 162/322; 162/DIG. 11; 162/336; 162/343

[58] Field of Search ..... 162/183, 185, 184, 322, 162/164.6, 168.2, 168.3, DIG. 11, 336, 343

[56] References Cited

U.S. PATENT DOCUMENTS

| | | | |
|---|---|---|---|
| 2,693,415 | 11/1954 | Schur | 162/183 |
| 3,589,980 | 6/1971 | Salomon | 162/DIG. 11 |
| 4,294,656 | 10/1981 | Beck et al. | 162/183 |
| 4,517,285 | 5/1985 | Woodward et al. | 162/183 |
| 4,940,512 | 7/1990 | Hendren et al. | 162/183 |
| 4,952,280 | 8/1990 | Hemel et al. | 162/DIG. 11 |

FOREIGN PATENT DOCUMENTS

| | | | |
|---|---|---|---|
| 718518 | 2/1980 | U.S.S.R. | 162/322 |

*Primary Examiner*—Peter Chin

*Attorney, Agent, or Firm*—Ostrolenk, Faber, Gerb & Soffen

[57] ABSTRACT

A method of manufacturing a web of fibers, especially a web of paper. The pulp is uniformly distributed through an outlet over the width of the machine and along a wire or between two wires. Most of the moisture is subsequently extracted from the pulp accommodated on or between the wires at a draining point. Various amounts of retaining agents are added to the pulp at sections across the headbox and the web in order to control the level of retention sectionally.

11 Claims, 1 Drawing Sheet

METHOD OF HOMOGENIZING THE CONSTITUTION OF A WEB OF PAPER

BACKGROUND OF THE INVENTION

The present invention relates to a method of manufacturing a web of paper with a headbox.

A headbox establishes the density and transverse fiber orientation of a pulp suspension at a point at least just upstream of the outlet gap from the headbox to attempt to achieve a paper weight per area and transverse fiber orientation which are satisfactory and constant over the entire width of the web. A headbox simultaneously also ensures that the constitution of the web is homogeneous. The constitution of the paper web is comprised of concentrations of its individual constituents, such as long and short fibers, fillers, etc.

The composition of a web of paper transversely to its length direction, i.e. across a web being produced, can be influenced by the process known from German Patent 3,514,554, for example. This patent describes varying the density of the pulp at particular points when necessary. But, no description is provided about how this is to be done.

German Patent 4,019,593 A1 describes varying the concentration $C_M$ of the particular sectional stream and accordingly of the material flowing out of the particular mixer in the event of deviations in weight at a particular point along the width of the web. To attain this, the ratio $Q_H/Q_L$ of the volumes of control streams supplied to the mixer is varied. It is difficult, however, with conventional valves to prevent the sectional stream $Q_H$ leaving the mixer from deviating unintentionally and wildly from an ideal concentration.

German Application OS 3,538,466 describes varying the flow through one section of a headbox to control the angle of fiber orientation where the pulp leaves the headbox. Fiber orientation will also vary wildly when the volume of a sectional stream deviates wildly from the ideal orientation.

German Patent 2,942,966 and OS 3,538,466 disclose varying the width of the outlet gap or slice or slot of the headbox with threaded spindles that pivot or curve the upper blade of the outlet gap, for example. This approach can vary the local flow of suspension and hence the fiber orientation. Local narrowing of the gap changes the direction in which the fibers are flowing at the constricted points as compared with other points across the gap. This means that, although the weight of the web can be made uniform over the width of the headbox outlet by this "displacement", the generally necessary overall orientation of the fibers in the web will be disrupted.

SUMMARY OF THE INVENTION

It is an object of the present invention to control the constitution of a web traveling through a paper making machine such that it will approach the ideal as nearly as possible.

The object is attained by uniformly distributing the pulp through a headbox outlet and across the width of the web and adding various amounts of a retaining, i.e. loosely binding, agent to the web at various sections thereof in order to control the level of retention, i.e. binding, of the constituents of the web at various sections of and across the web.

The inventors realized that variations in retention produce a non-uniform distribution of weight throughout a web traveling through a paper-making machine, but that this situation can be controlled by adding a liquid that differs in its properties from the pulp in the major stream. Adding pulp with a high proportion of long fibers or ash to the edges of the web, for example, can help to improve the transverse constitution. This goal had been achieved in the prior art by varying the blend or by sectional density variations with the object of attaining the best possible distribution of weight. When the web is drained in the forming section, in accordance with the degree of retention, short fibers and ash will have a greater tendency to drop through the meshes of the wire along with the water. Thus, even though the transverse distribution of weight has been successfully corrected, the transverse constitution will not be homogeneous and hence not ideal.

Deviations from mean retention are accordingly restricted according to the invention by the addition of a retaining agent at sections across the headbox outlet and the web to limit the changes in the paper's properties at points of extreme deviations. Examples of such retaining agent include polyacrylamide, polyamine, and polyethylene amine.

The method is applicable to all types of headboxes (single-layer and multiple-layer or multiple-ply headboxes, gap-shaper headboxes, long-wire headboxes, etc.).

Other features and advantages of the present invention will become apparent from the following description of the invention which refers to the accompanying drawings.

DETAILED DESCRIPTION OF THE INVENTION

Figure 1:
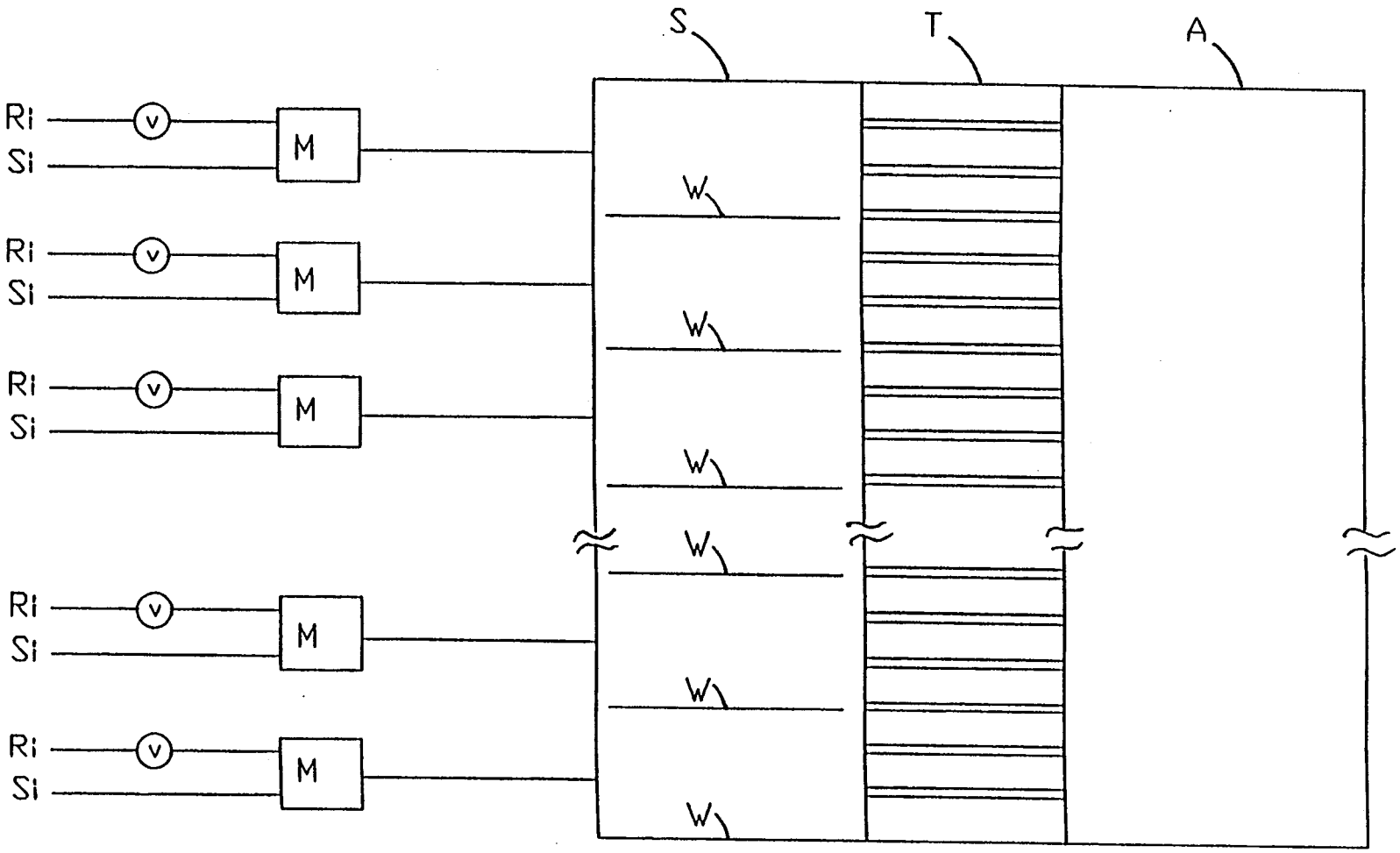
FIG. 1 diagrammatically illustrates the main structural blocks of a headbox for practicing the present invention.

With reference to FIG. 1, which is a schematic top view of a headbox, several pairs of lines $R_i$, $S_i$ lead into the mixers M as shown. In each pair, the line $S_i$ supplies stock $S_i$ to its respective mixer M. The other line $R_i$ supplies a retainer $R_i$ to its respective mixer through a valve V, at a rate which is controlled by the valve.

Each mixer M mixes the stock with the retainer and supplies the mixture to a respective compartment in a section S of the headbox. The compartments in section S are defined and separated from one another by the partitions W. Immediately downstream of the section S is a section T that generates the requisite microscopic-scale turbulence, in a manner well known in the art. Immediately downstream of the section T is a projection slice that releases the stock over the total width of the forming wire (not shown), again in a manner well known in the art.

The retaining agent flows, as noted, through the valves V which are integrated into the lines supplying the retainer. Accordingly, these valves regulate how much retainer enters the system in accordance with how much retention, i.e. binding, is needed at each point across the width of the web. As retaining/binding agents, one may use polyacrylamide, polyamine, polyethylene amine which are but examples of the type of retaining agents to be used. These retainers are constituted, in contrast to the water in the suspension, of long-chained molecules. In accordance with the process of the present invention, the retaining agents are added to those sections of the paper web and in an amount which is sufficient to inhibit or reduce the loss of too many accepts, i.e. fines, from the web. The level of fines across the machine is measured and the retaining agent is added to the compartments where an insufficient amount of fines remains in the paper web.

The result of injecting the retaining agent is that fewer fines drain out along with the water as the web forms. The inventors believe that the physical mechanism at play which achieves the salutary effects of the present invention is the construction of polymeric bridges between the fibers or neutralization of charges on the fibers to thereby enhance the forces of adhesion between the fiber parts resulting in a reduced loss of fines.

One drawback to the addition of the retaining agents and a factor behind the prior art's reluctance to introduce such retainers is that it promotes flocculation, which interferes with the formation of the web. Therefore, in order to achieve the beneficial results of the present invention, one skilled in the art must determine on a case-by-case basis how much flocculation is to be tolerated in order to obtain the positive results of improving distribution of the filler throughout the web.

A primary advantage of the present invention derives from the fact that it allows the constitution of the web to be as homogeneous as possible from one end thereof to the other, across its entire width.

The sheet-forming wire sometimes wears out at one edge for example, which results in variations in the stock retention across the web. This defect is usually corrected by adjusting the baffle slice to release more stock to those areas of the wire where retention is low in order to compensate for the loss of fillers. However, adjusting the baffle slice leads to problems with the orientation of the fibers in the web, because opening and closing the gap in the baffle slice can lead to undesirable transverse flow.

Consistent with the aim of the present invention to render retention as uniform as possible over the entire width of the machine while avoiding excessive manipulation of the baffle slice, homogeneous retention with the present invention is ensured by applying/supplying the retaining agent, compartment by compartment, eliminating the need for too many adjustments of the baffle slice and hence poor fiber orientation.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Method for operating a headbox of a paper making machine, comprising the steps of:

feeding a plurality of mixers of the headbox with a first stream of paper stock and selectively feeding the mixers with a second stream of retaining agent;

feeding mixed contents of each of the mixers to a respective stock holding compartment of a plurality of stock compartments arrayed across a width dimension of the headbox; and controlling the amount of retaining agent flowing into each of the mixers to achieve uniform retention characteristics across an entire paper web formed by stock sprayed from the headbox.

2. The method of claim 1, including feeding the stock from the stock compartments into a further section of the headbox in which the stock is subjected to microscopic-scale turbulence.

3. The method of claim 2, including feeding the stock from the further section to a projection slice and releasing the stock from the projection slice over the entire width of a forming wire of the paper making machine.

4. The method of claim 1, wherein the retaining agent has a molecular structure which is long-chained as compared to water molecules.

5. The method of claim 4, wherein the retaining agent comprises at least one compound selected from the group consisting of polyacrylamide, polyamine, and polyethylene amine.

6. The method of claim 1, including providing a respective valve in a feeding path of the retaining agent to the mixer and including controlling the setting of the valve.

7. A headbox for a paper making machine, the headbox comprising:

a plurality of mixers each including means to receive a first stream of paper stock and a second stream of retaining agent, each of the mixers being effective to mix stock and retaining agent;

a stock holder comprising a plurality of compartments, each compartment being connected to receive admixed contents of a respective one of the mixers, the compartments being arrayed across a width dimension of the headbox; and means for controlling the amount, if any, of the retaining agent flowing into each of the mixers to achieve uniform retention characteristics across an entire paper web formed by stock sprayed from the headbox.

8. The headbox of claim 7, further comprising a supply of paper stock and a supply of retaining agent, wherein the retaining agent comprises at least one compound selected from the group consisting of polyacrylamide, polyamine, and polyethylene amine.

9. The headbox of claim 7, further comprising a further section of the headbox which is coupled to the compartments and means in the further section to cause microscopic-scale turbulence in the stock.

10. The headbox of claim 9, further including a projection slice coupled to the further section and means to release stock from the projection slice over the entire width of a forming wire used to form the paper web.

11. The headbox of claim 10, further including a respective valve associated with each of the mixers for controlling therewith the amount, if any, of retaining agent that is to be supplied to each respective mixer.

* * * * *